US007503555B2

(12) United States Patent
Dobrovolsky

(10) Patent No.: US 7,503,555 B2
(45) Date of Patent: Mar. 17, 2009

(54) SYSTEM FOR AND A METHOD OF PRODUCING A BOOK ON DEMAND

(75) Inventor: Sasha Dobrovolsky, San Leandro, CA (US)

(73) Assignee: ePAC Technologies, San Leandro, CA (US)

( * ) Notice: Subject to any disclaimer, the term of this patent is extended or adjusted under 35 U.S.C. 154(b) by 340 days.

(21) Appl. No.: 10/914,681

(22) Filed: Aug. 9, 2004

(65) Prior Publication Data

US 2006/0028662 A1 Feb. 9, 2006

(51) Int. Cl.
*B65H 37/04* (2006.01)

(52) U.S. Cl. ..... 270/58.07; 270/1.01; 270/52.17; 270/58.08

(58) Field of Classification Search ..... 270/1.01, 270/52.17, 58.07, 58.08; 412/1, 2, 4, 16, 412/19, 33

See application file for complete search history.

(56) References Cited

U.S. PATENT DOCUMENTS

| | | | | |
|---|---|---|---|---|
| 4,022,455 | A * | 5/1977 | Newsome et al. | 270/52.29 |
| 5,198,841 | A * | 3/1993 | Sakamoto | 347/118 |
| 5,465,213 | A | 11/1995 | Ross | |
| 5,960,233 | A * | 9/1999 | Goto et al. | 399/69 |
| 6,142,721 | A * | 11/2000 | Marsh | 412/1 |
| 6,176,480 | B1 * | 1/2001 | Yonenuma et al. | 270/58.08 |
| 6,193,458 | B1 * | 2/2001 | Marsh | 412/1 |
| 6,416,082 | B1 * | 7/2002 | Gayoso | 281/29 |
| 2002/0061238 | A1 | 5/2002 | Marsh | |
| 2004/0188910 | A1 * | 9/2004 | Trovinger et al. | 270/4 |
| 2004/0205636 | A1 | 10/2004 | Kasahara et al. | |

FOREIGN PATENT DOCUMENTS

| | | |
|---|---|---|
| JP | 2002-207815 | 1/2001 |
| WO | WO 92/02888 | 2/1992 |
| WO | WO 00/03876 | 7/1999 |
| WO | WO 01/56794 | 2/2001 |
| WO | WO 2004/095202 | 2/2004 |

* cited by examiner

*Primary Examiner*—Gene Crawford
*Assistant Examiner*—Leslie A Nicholson, III
(74) *Attorney, Agent, or Firm*—Reed Smith LLP

(57) ABSTRACT

A system for manufacturing a book on demand includes a first printing unit for printing a first component of the book (i.e. a cover), a second printing unit for printing a second component of the book (i.e. a text block), and a binding station for binding the first component and the second component together. The system may further include a computer control system receiving information relating to the book to be manufactured, the information comprising information relating to the content of said first or second component and information relating to the finished size of the book. The computer control system initiates—among other functions—manufacture of the first component by said first printing unit, receives a signal that the printing of the first component is successful and, after receipt of this signal, initiates printing of the second component by said second printing unit. The first component could be stored in a buffer until the second component is ready. The advantage of this hierarchy is that the process which is more time consuming and/or sensitive with respect to disturbances and/or more expensive can control the over-all process. Rejects of completed books not fulfilling the quality criteria are avoided and down-times minimized. Also avoided is the requirement to store the second component until the first component is ready.

49 Claims, 6 Drawing Sheets

SYSTEM FOR AND A METHOD OF PRODUCING A BOOK ON DEMAND

BACKGROUND OF THE INVENTION

1. Field of the Invention

The present invention relates generally to book printing, and more particularly to a system for and a method of producing a book on demand.

2. Description of the Related Art

Typically a book comprises a plurality of text pages stacked one upon the other (referred to as book block) and a cover overlying the front, back and spine of the book block. The book block is typically printed in black and white, whereas the cover is typically printed in color and on paper which may be thicker or of higher quality. Books are generally mass produced by offset printing to ensure cheap manufacture and, after distribution all over the world, general accessibility. This traditional method requires the publishing industry to print a large number of copies (at least several hundreds, generally thousands), and, after the books are produced, to store, distribute and sell them to retailers. During production, the components like the book block and cover are produced separately off-line and joined later. To make up for later production imperfections, the printing house produces not only the required numbers of components, but also excess components. For example, to produce 1000 complete books the printing house may print 1200 book blocks and 1300 covers. Consequently, at least a part of these excess components go to waste. Furthermore, since the demand for a book is very hard to estimate, large numbers of books, typically up to 40%, go to waste when they are not sold. Production, storage and disposal of these excess books not only affect the price of the finished product but also burden the environment. Further disadvantages are the slowness of the supply chain, which usually comprises a retail store, and the impossibility of procuring a book not in print anymore and thus unavailable.

In recent years, book printing has undergone changes as computer technology and laser printers have advanced. This new technology allows for machines capable of printing books with lower numbers of copies "on demand". So far, book blocks and covers are produced separately and manually inserted into a binder for binding. Quality control is performed by visual inspection, when the operator inserts the covers and book blocks into the binder. Due to the manual handling of the components, low numbers of copies (down to one single copy) cannot be produced economically.

International patent application WO 92/02888 discloses a system and a method of manufacturing a single book copy, which is especially adapted for direct consumer sales, since the manufacture of a selected book can take place at the point of sale. The apparatus comprises a computer storage of the text, the color graphic cover and sales information for a large number of books. A computer module permits the consumer to scan the sales information and select a book to be purchased. Upon command, the system automatically prints the text and color cover of the selected book, cuts the pages to a predetermined size and binds the pages and cover together while the customer waits.

Another system and method for printing a book on demand is known from U.S. published patent application 20020061238 A1. The apparatus includes one or more text page printers and a color cover printer. The text page printers print the text pages and form them into a book block. The color printer prints the cover. The book block and the cover are delivered to a binding station at which the spine of the book is adhesively bound to the cover. The book is then delivered to a trimming station where excess margins are trimmed from the book. All transfers are accomplished with a carriage which moves along a linear work path.

These known systems are optimized for low production rates, especially for manufacture at the place of sale. Since they are "in-line systems" they are only capable of manufacturing one book at a time. This means printing and binding of the book block and the cover must completed before the system is ready for the next job. High down-times of the different units (printing, binding) of the known systems are accepted. The known systems are thus not suited to replace the conventional book factories efficiently and economically. Nor are they equally suited for efficient production of high numbers of copies, as well as efficient production of a lower number of copies, such as a single copy.

SUMMARY OF THE INVENTION

In general, according to a first embodiment of the present invention, a system for manufacturing a book on demand comprises a first printing unit for printing a first component of the book (i.e. a cover), a second printing unit for printing a second component of the book (i.e. a text block), and a computer control system which initiates printing of the second component only after receipt of a triggering signal, which is preferably a signal that the manufacture of the first component is successful. The system may further comprise a binding station for binding the first component and the second component together. The computer control system preferably receives or has (in a memory unit) information relating to the book to be manufactured, the information comprising information relating to the content of the first or second component and information relating to the finished size of the book.

The computer control system initiates—among other functions—manufacture of the first component by the first printing unit, receives from the first printing unit the triggering signal and, after receipt of this signal, initiates printing of the second component by the second printing unit. In other words, the printing of the first component is the leading (master) process and the printing of the second component is the following (slave) process, which is initiated only after the master process is successfully completed or at least partly completed. The advantage of this hierarchy is that the process which is more time consuming and/or sensitive with respect to disturbances and/or more expensive can control the overall process. Rejects of completed books not fulfilling the quality criteria are minimized, since the quality of the first component is controlled prior to manufacture of the second component. The requirement to store the second component until the first component is ready can also be avoided, though buffering the second component is possible.

In one embodiment, the leading "master" first component is a cover and the following "slave" second component is a book block, since production of a cover is ordinarily considered more demanding. However, the role of the "master" and the "slave" component may by reversed.

In other aspect of the present invention, an inventive method of manufacturing a book on demand, the book comprising at least a first component and a second component, comprises initiating the production of the first component and producing the first component; initiating the production of the second component and producing the second component, wherein the production of the second component is initiated only after receipt of a triggering signal, preferably a signal that the production of the first component is successful.

A further embodiment of the present invention concerns manufacturing a plurality of books on demand, which may be of a different size and have a different content, each of the books comprising at least a first component and a second component. The method includes introducing a first component of a first book, initiating the production of a second component of the first book after receipt of a signal that the production of the first component of the first book is successful, and producing the second component of the first book, producing a first component of a further book after completion of the production of the first component of the first book, and producing a second component of a further book after completion of the production of the second component of the first book. A plurality of books can thus be manufactured one after the other while the different processes run in parallel (i.e. for the manufacture of three books, the following processes run in parallel: printing $3^{rd}$ cover, printing $2^{nd}$ text block, binding $1^{st}$ book), thereby reducing down-times of the processing units (printing, binding etc.).

A further inventive system for manufacturing a book on demand comprises a first printing unit for printing the first component, a second printing unit for printing the second component, a first transfer unit for transferring the first component to a further station, i.e. a binding station, a second transfer unit for transferring the second component to the further station, and a first buffer unit for buffering at least the first component at least until a corresponding second component is transferred or ready to be transferred to the further station. The first buffer unit is preferably a mechanical buffer unit such as a conveyor or robotic storage device, which allows access to any desired individual book component at any time. This embodiment minimizes the down-times of the production units considerably. Furthermore, it can be combined advantageously with the "master-slave" manufacturing hierarchy as described above.

Another method of manufacturing a book on demand comprises initiating the production of the first component and producing the first component, initiating the production of the second component and producing the second component, transferring the first component to another station via a first buffer, transferring the second component to a next station (in an arbitrary order). The fist buffer is preferably a mechanical buffer unit, such as a conveyor or robotic storage device. Here, the first component waits until the second component and/or the next station is ready for further processing, for example binding. The first and second components can be produced simultaneously or sequentially. In the latter case, it is preferred that the production of the second component is initiated only after completion of the first component. In other words, the completion is a triggering signal for the production of the second component as described above. To optimize down time, the second component can also be transferred to a second buffer before being transferred to the next station.

In all the described embodiments, the printing units or manufacturing units can comprise one or more printers each. In the case of one printer, this printer receives an order (job) relating to a first or second component of a book to be printed, and prints this component subsequently. If the component has more than one page, all required pages are printed sequentially one after the other, or, depending on the format, also side by side on a continuous paper web. The printer is then ready for printing a component of the next book. All components of different books (which may have an identical or different content) to be manufactured are printed sequentially one after the other. For the first component, the order of printing may correspond to the order of entry of the corresponding order to manufacture a book into the present system. If the printing of the first component fails for some reason, the corresponding printing job is entered again into the first printing/manufacturing unit, i.e. into a first waiting list. The order of printing of the second components corresponds to the order of completion of first components. If the printing of a second component fails for some reason, the corresponding printing job is entered again into the second printing/manufacturing unit (i.e. into a second waiting list).

The same process applies generally if the first or second printing/manufacturing unit comprise more than one printer. The printers work in parallel, which means that a first printer prints a first job of a first waiting list while a second printer prints a subsequent second job of the first waiting list, and so on. It is also possible to split up a job between different printers in order to save time especially with components having a high number of pages.

The first printing unit may comprise one or more printers, such as one or more color printers, preferably digital laser printers, for printing the cover. It may further comprise further units for finishing the cover, such as a laminating and/or coating unit. The second printing unit may also comprise one or more printers for printing the book block, either black and white or color digital laser printers. It may further comprise a cutter to cut a continuous web into single sheets and for forming a book block from single sheets, such as a jogger device. Alternatively, the printer may be a single sheet printer, or signatures can be formed by folding a continuous web and then forming them into book blocks.

The present invention allows for the manufacture of a plurality of books in a fully automated way. Contrary to the prior art "on demand" book manufacturing apparatuses, the present invention employs production units suited for mass production volumes, and combines them in a novel and unique way. Down-times of the production units of the system as well as rejects can be minimized, and a high production rate and a high quality of the books can be achieved. Transfer of the components and the finished books between the production units can be fully automatic. Since the components of one book are produced "online" and in dependence on each other, the manufacture of excess components is advantageously avoided, contrary to prior art book factories, where a higher number of components is produced off line and joined at a later production stage. The present invention thus provides a fully automated book factory, which is able to replace the traditional book factories, while still allowing the production of a flexible number of copies of a book, even down to a single copy.

BRIEF DESCRIPTION OF THE DRAWINGS

The present invention will be readily understood by the following detailed description in conjunction with the accompanying drawings, wherein like reference numerals designate like structural elements, and in which.

DETAILED DESCRIPTION OF THE INVENTION

The following description is provided to enable any person skilled in the art to make and use the invention and sets forth the best modes contemplated by the inventor for carrying out the invention. Various modifications, however, will remain readily apparent to those skilled in the art. Any and all such modifications, equivalents and alternatives are intended to fall within the spirit and scope of the present invention.

In general, according to a first embodiment of the present invention, a system for manufacturing a book on demand comprises a first printing unit for printing a first component of the book (i.e. a cover), a second printing unit for printing a second component of the book (i.e. a text block), and a computer control system which initiates printing of the second component only after receipt of a triggering signal, which is preferably a signal that the manufacture of the first component is successful. The system may further comprise a binding station for binding the first component and the second component together. The computer control system preferably receives or has (in a memory unit) information relating to the book to be manufactured, the information comprising information relating to the content of the first or second component and information relating to the finished size of the book.

The computer control system initiates—among other functions—manufacture of the first component by the first printing unit, receives from the first printing unit the triggering signal and, after receipt of this signal, initiates printing of the second component by the second printing unit. In other words, the printing of the first component is the leading (master) process and the printing of the second component is the following (slave) process, which is initiated only after the master process is successfully completed or at least partly completed. The advantage of this hierarchy is that the process which is more time consuming and/or sensitive with respect to disturbances and/or more expensive can control the overall process. Rejects of completed books not fulfilling the quality criteria are minimized, since the quality of the first component is controlled prior to manufacture of the second component. The requirement to store the second component until the first component is ready can also be avoided, though buffering the second component is possible.

Figure 1:
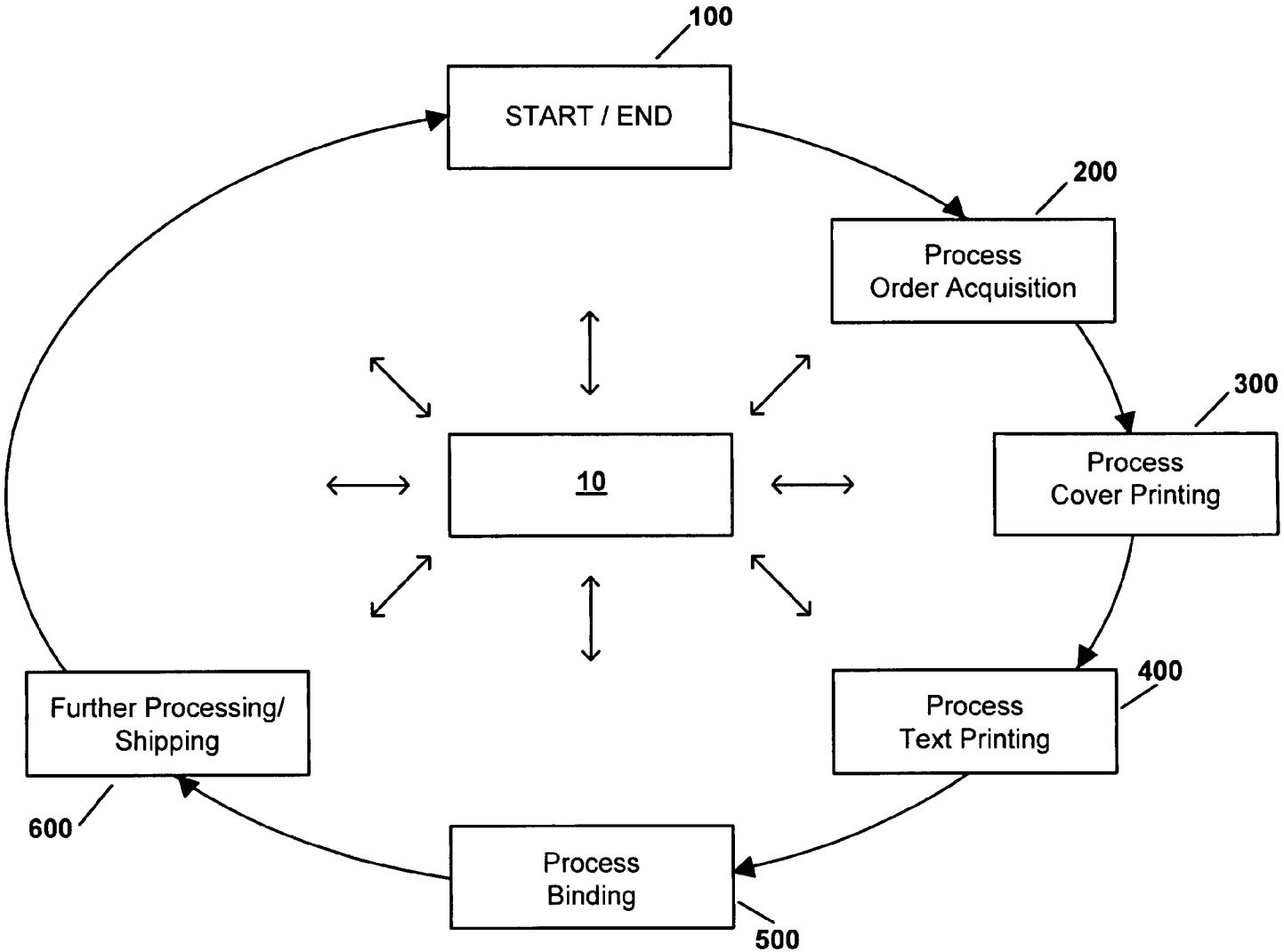
FIG. 1 is a flow chart of a general method for manufacturing books.

FIG. 1 is a flow chart of a method for manufacturing books which is consistent with the present invention. Each book to be manufactured sequentially runs through the following processes: "Order Acquisition" 200, "Cover Printing" 300, "Text Printing" 400, "Binding" 500, and "Further Processing and Shipping" 600. The processes 300, 400, 500 are described below in detail with reference to FIGS. 5-7. Reference numeral 100 designates a start and an end of the overall process. The whole sequence of processes is repeated continuously until all book orders completed. It is possible and preferred that processes belonging to different books run in parallel to ensure maximum efficiency of the complete system. Thus, maximum production rates and minimum downtimes of the different stations independent of the numbers of copies (number of identical books) are achieved.

A computer control system 10 initiates and controls all processes. The flow of information between the computer control system 10 and the different processes and the respective units carrying out these processes is schematically indicated by double arrows.

In this embodiment, the process "Text Printing" 400 is initiated only after completion of the previous process "Cover Printing" 300. This means, that in this case the process "Cover Printing" 300 is the master process and the cover can be identified with the first component. Correspondingly, the process "Text Printing" 400 is the slave process and the book block can be identified with the second component.

Figure 2:
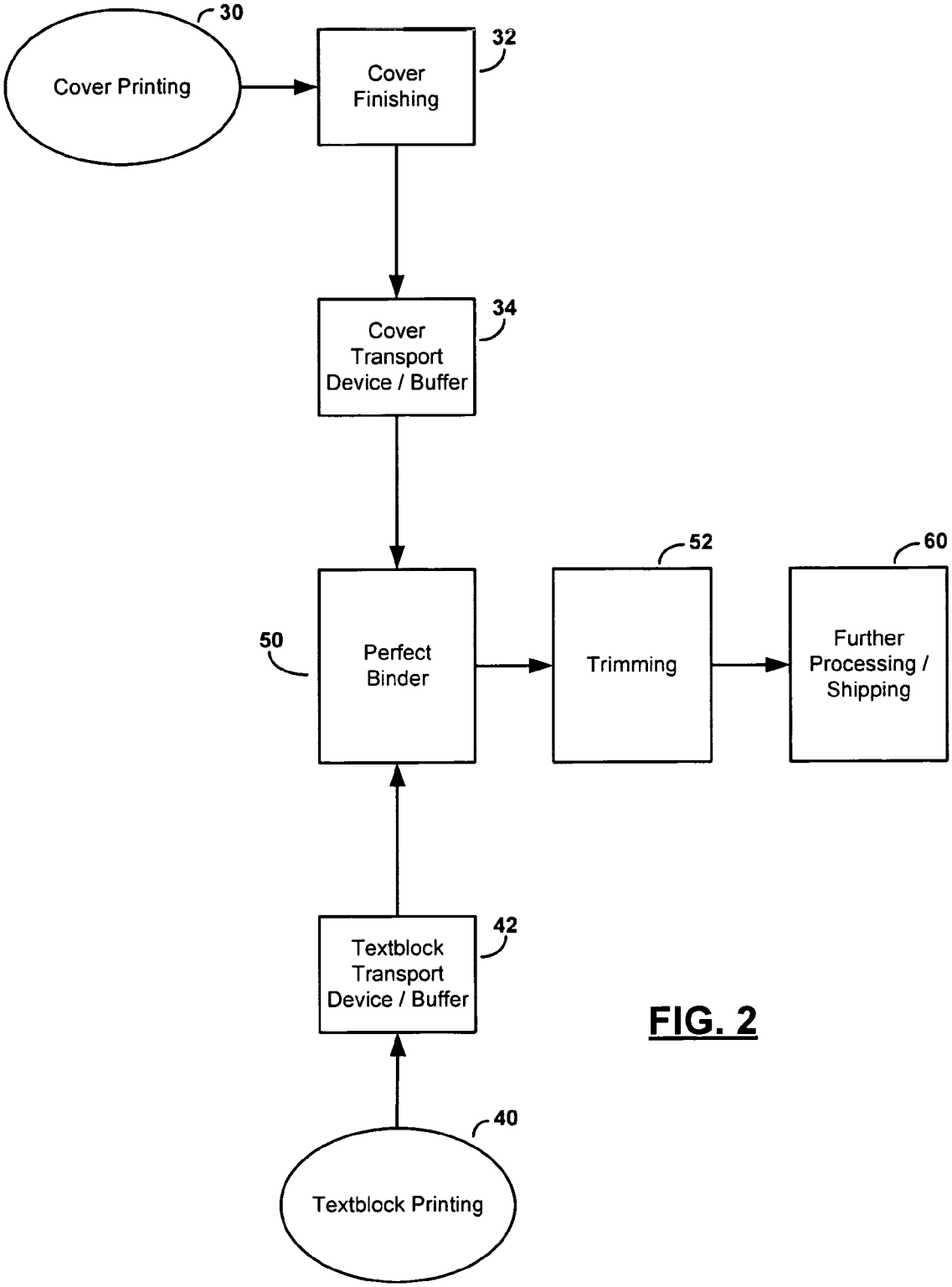
FIG. 2 is a schematic depicting different manufacturing stations of an automated book factory according to on embodiment of the present invention.

FIG. 2 shows different manufacturing units of an automated book factory according to the invention as well as the material flow between these units. Covers belonging to one or more books are printed in a first printing unit 30, here a cover printing unit 30 with at least one color printer. The printed covers are then transferred to a finishing unit 32, preferably a laminating unit for laminating the printed cover. The quality of the printed and laminated covers is controlled (as described below with reference to FIG. 6), and if the quality is acceptable, the cover enters a transfer unit 34. This transfer unit 34 has a double function. First, it serves to transfer the cover to a binding station 50. Second, it serves as a buffer or storage to store the cover until a book block matching this cover is ready for binding. As described in more detail below with reference to FIGS. 5 and 6, the manufacture of the book block is initiated only after the manufacture of the cover is completed.

Figure 4:
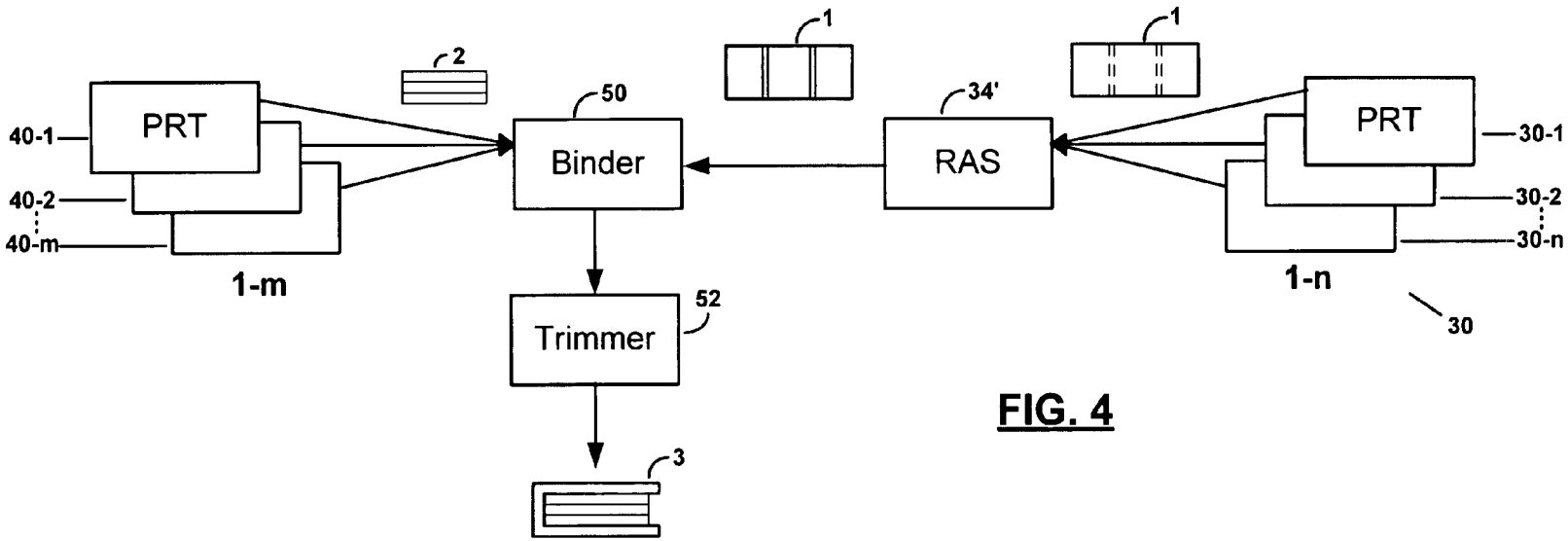

As shown in FIG. 4, which shows a slightly different embodiment of the inventive system, a storage unit 34' is preferably a random access storage unit (RAS). This means that components such as covers or book blocks can be extracted from the storage independent of the order of their entry. The RAS may be represented by a plurality of one-item-storage elements, i.e. bags or trays, which are stationary or circled along a closed path of movement. The storage unit and its one-item-storage elements, respectively, can be accessed in a fully automated way. The computer control system of the inventive system is therefore preferably able to track all components in the system. This enables the control to know the absolute or relative position of each component in order to match together the cover and book block of each particular book. Tracking can be done purely electronically and/or by means of physical labels applied to the book components, i.e. bar codes, transponders, etc. which are read by appropriate reading device.

Turning back to FIG. 2, a second printing unit 40 is used for printing book blocks. These book blocks are transferred to the binding station 50 via a transfer unit 42. This transfer unit 34, may also have a buffering storage function. In this case, a first-in-first-out function is sufficient. Transfer unit 42 may be implemented by a conventional band or gripper conveyor.

Covers and book blocks are automatically delivered to the binding station 50, where they are bound together, preferably with an adhesive. The bound components are then transferred to a trimming unit 52, where excess margins are cut, such that a perfect bound book is formed. The book is then transferred to a processing unit 60 for further processing and shipping.

As explained below with reference to FIGS. 3 and 4, only one of the transfer units 34 and 42 of FIG. 2 needs to have buffer/storage function to ensure maximum utilization of the printing units 30, 40. It is however preferred that both transfer units include a storage capacity as this has further benefits with respect to the down-times of the preceding stations. In particular, the printing units 30, 40 do not have to be stopped when the binding station 50 undergoes maintenance if there is a storage with sufficient capacity between each of the printing units 30, 40 and binding station 50.

Figure 3:
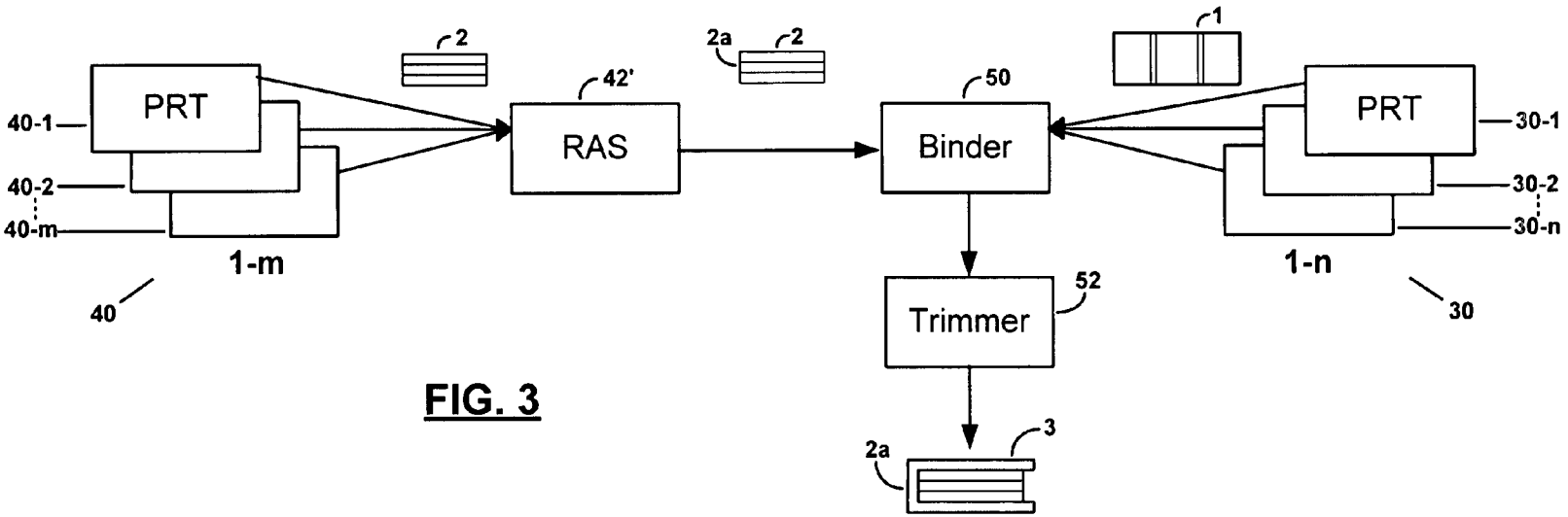
FIGS. 3 and 4 are schematics depicting two different systems for manufacturing books with a first manufacturing unit, a second manufacturing unit, a binding unit, a trimming unit and a random access storage for storing book components.

FIGS. 3 and 4 show two principal embodiments of the inventive system. The system comprises a first printing unit 30, which comprises a plurality of printers for printing covers 1 (i.e. n printers 30-1, 30-2, . . . 30-n). The system further comprises a second printing unit 40 for printing book blocks 2, which comprises a plurality of printers (i.e. m printers 40-1, 40-2, . . . 40-m). The numbers of the printers depend on their capacity. For example, there could be more text printers than cover printers, if the printing of a text generally takes longer than production of a cover. Both embodiments further comprise a binding station 50 and a trimming station 52. These stations 50, 52 may also comprise multiple trimmers/binders. The completed book 3 with the cover 1 wrapped around the book block 2 and bound to the spine 2*a* of the book block 2 is schematically shown at the exit of the trimming station 52.

FIG. 4 generally corresponds to the embodiment shown in FIG. 2 with the cover 1 being the leading (first) component and the book block 2 being the following (second) component. Consequently, as the cover 1 waits for the production of its associated book block 2, the cover 1 is transferred to a random access storage (RAS) 34, which may separate from or integrated into the transfer unit (not shown) for transferring the cover 1 to the binding station 50. The book block 2 is directly transferred to the binding station 50.

FIG. 3 corresponds to an embodiment of the inventive system in which the book block 2 is the leading (first) component, and the cover 1 is the following (second) component. Here, the book blocks 2 are stored in a RAS 42' until printing (and if applicable further finishing actions like laminating) of the cover 1 is completed.

Figure 5:
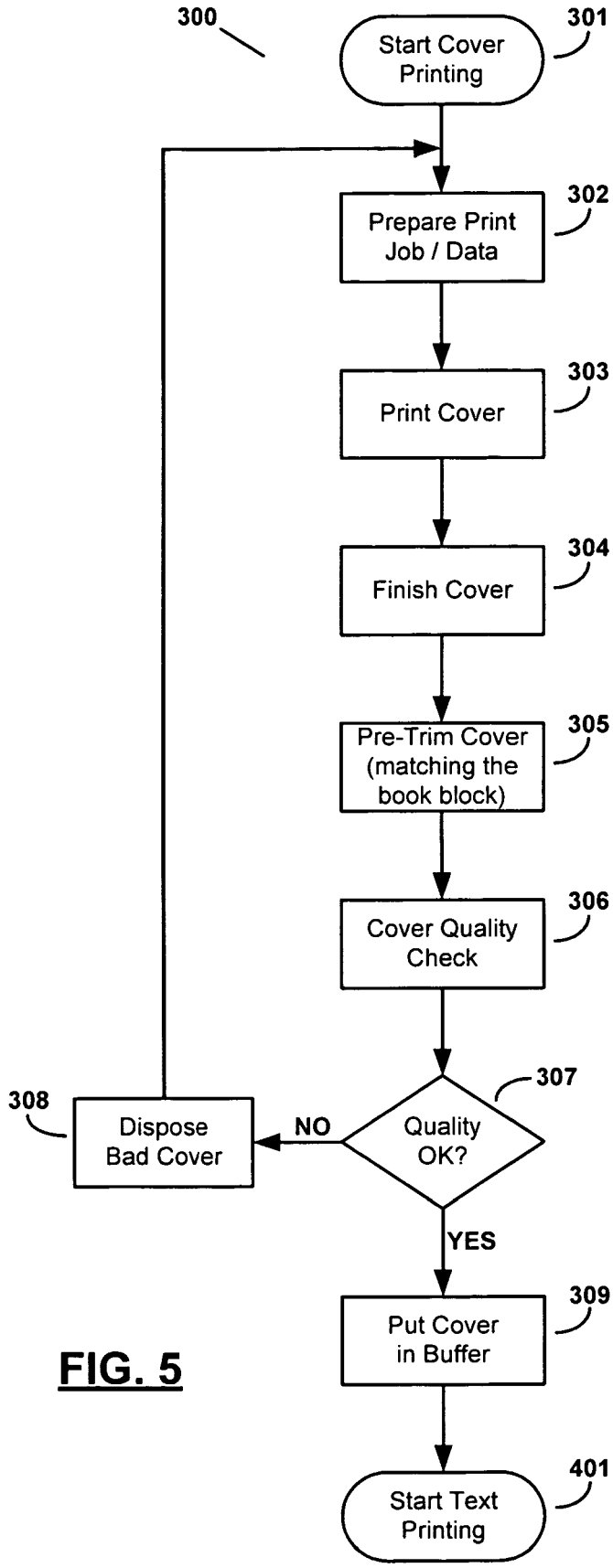
FIG. 5 is a flow chart of a process "Cover Printing" as shown in FIG. 1.

FIG. 5 illustrates the cover printing process 300. After the start of the cover printing 301, the data is prepared for printing and the corresponding print job is sent to the cover printing unit 30, i.e. to one of the available printers 30-1, 30-2, . . . 30-n shown in FIG. 3 or 4. If all the printers are busy, the print job is entered into a waiting list of the printing unit 30. The next sub-processes are printing the cover 303 and finishing the cover 304 (i.e. laminating). To match the book block, the cover may also be pre-trimmed (step 305). The quality of the cover is then checked by a quality check unit, which also works fully automatically (step 306/307). If the quality is not sufficient, the steps 302-306 are repeated, and the bad cover is discarded. If the quality is sufficient, the cover is transferred to the buffer (step 309), and the printing of the text (book block) is initiated (step 401). In further detail, the computer control system receives a signal regarding to the quality of the cover and sends a corresponding signal/order to the text printing unit 40. Cover printing 300 may also include a step (not shown), in which a label is applied to the cover, which enables tracing and matching the components at a later stage.

Figure 6:
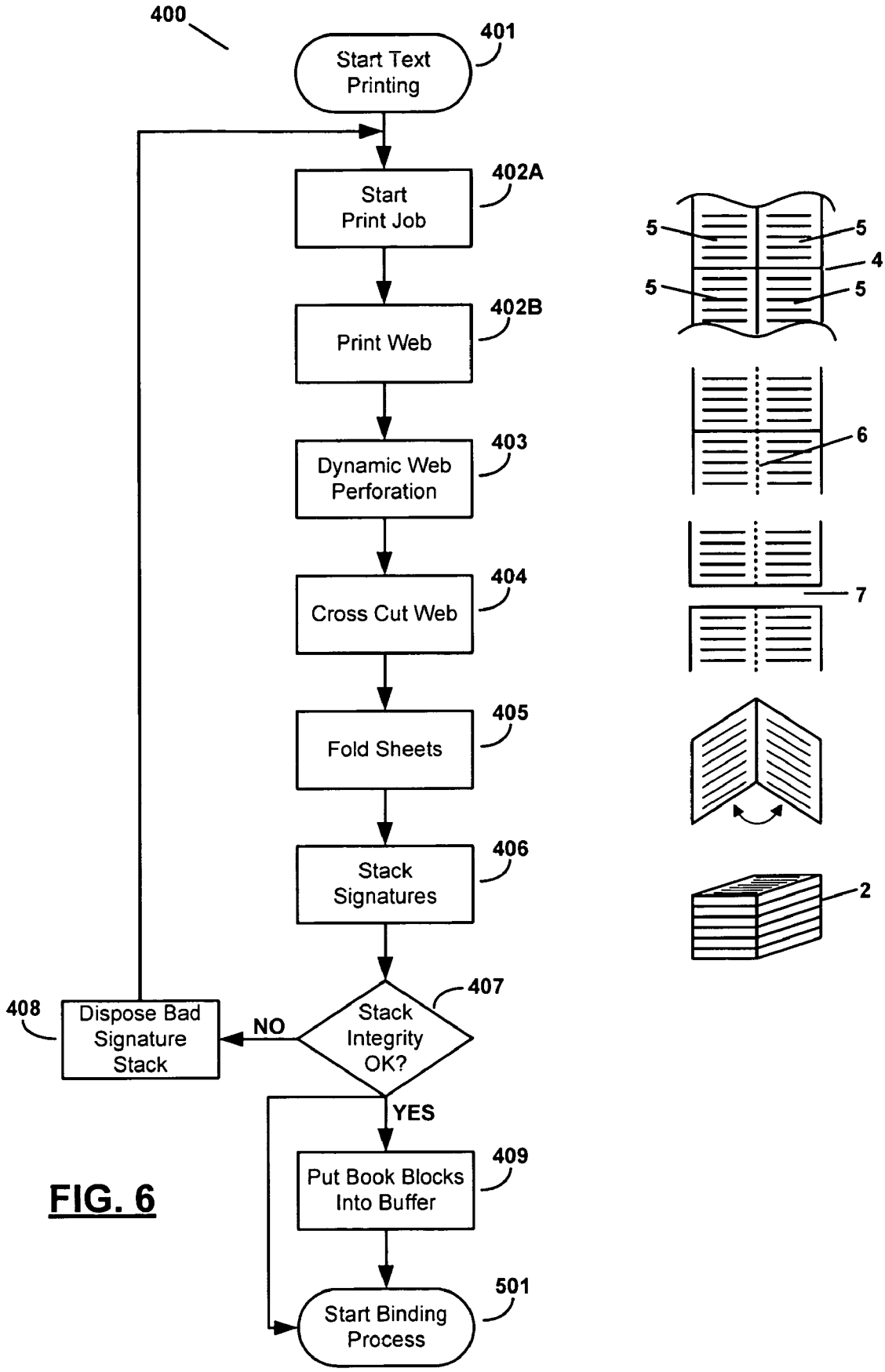
FIG. 6 is a flow chart of a process "Text Printing" as shown in FIG. 1.

FIG. 6 shows the book block printing process 400. It also shows schematically the book block 2 in different stages of its production. After initiating the printing process (step 401), the print job is started by transferring the print data to the book block printing unit 40 (step 402). The job is entered into a waiting list, if the printing unit 40 is not yet ready for printing. Since a book block generally comprises a plurality of pages, it is preferable to print the pages 5 one after the other on a continuous paper web 4 (step 402). If the format of the pages and the web allows for it, the pages 5 can also be printed side by side on the web 4. The web 4 is then perforated in a longitudinal direction to facilitate folding the web or separating the pages from each other (step 403, perforation 6). To form separate sheets, the web is subsequently cut transversely (transverse cut 7), using a cross cutting unit (step 404). The sheets are folded and stacked to form a signature book block 2 (steps 405, 406). Next, the stack integrity is checked (step 407). If the quality of the stack is rejected, the stack is discarded and the printing (steps 402-406) repeated (step 408). If the stack fulfills the requirements, the book block is transferred directly to the binding station 50, and put into a buffer if the binding station 50 is not yet ready (step 409). The binding process starts as soon as the binding station is ready (step 501).

It is also possible to print the pages on single sheets. In this case, the step 402 is "print on sheets", and steps 403, 404 can be dropped. If the sheets do not require folding, step 405 can be dropped in both cases.

Figure 7:
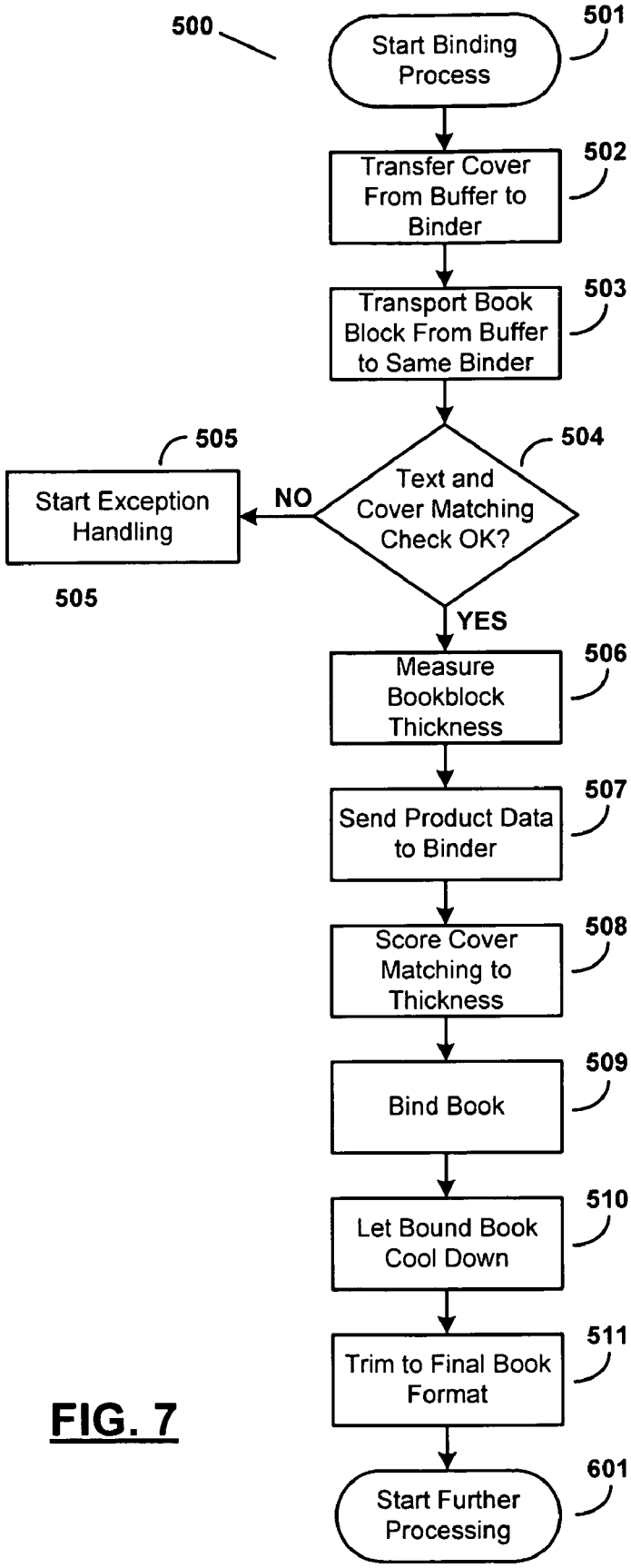
FIG. 7 is a flow chart of a process "Binding" as shown in FIG. 1.

FIG. 7 shows the binding process 500. After initiation of the binding process (step 501), the cover and book block are transferred to the binding unit 50 (steps 502, 503). If the binding unit has more than one binder, the components are transferred to the same binder. Step 503 is shown here to follow step 502, but it is also possible to reverse the order, i.e. have the cover follow the book block. The latter is especially advantageous if there is only a buffer for the covers whereas the book blocks are transferred directly to the binding unit. In step 504 it is checked whether text and cover match, i.e. by automatically comparing labels previously applied to both components. If the components do not match, exception handling is started (step 505). If they match, the binding process continues with measuring the thickness of the book block (step 506), sending product data to the binder (step 507), scoring the cover matching to the thickness (step 508), binding the components together, especially by applying a hot melt adhesive (step 509), letting to book cool down (step 510) and trimming it to the final book format (step 511). Any further processing/shipment can then be started (step 601). Generally, all known binding techniques can be employed. All actions described with respect to FIG. 5-7 are performed under the control of the computer control system 10. The computer control system 10 may be represented by a central computer or represented by a plurality of decentralized control units, i.e. control units belonging to the different units.

A further embodiment of the present invention concerns manufacturing a plurality of books on demand, which may be of a different size and have a different content, each of the books comprising at least a first component and a second component. The method includes introducing a first component of a first book, initiating the production of a second component of the first book after receipt of a signal that the production of the first component of the first book is successful, and producing the second component of the first book, producing a first component of a further book after completion of the production of the first component of the first book, and producing a second component of a further book after completion of the production of the second component of the first book. A plurality of books can thus be manufactured one after the other while the different processes run in parallel (i.e. for the manufacture of three books, the following processes run in parallel: printing $3^{rd}$ cover, printing $2^{nd}$ text block, binding $1^{st}$ book), thereby reducing down-times of the processing units (printing, binding etc.).

The invention concerns a closed system for manufacturing books. Book components as well as finished books are produced and handled fully automatically without manual intervention. They do not leave the system until the book is ready for shipment, with the exception of components not fulfilling predetermined quality requirements. The production of excess components is avoided, as only the components actually needed are produced.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A system for manufacturing a book on demand, the book comprising at least a first component and a second component, the system comprising:

a first printing unit for printing the first component;

a second printing unit for printing the second component;

a computer control system which initiates printing of the first component by the first printing unit, receives a triggering signal and, after receipt of this triggering signal, initiates printing of the second component by the second printing unit; and a first buffer unit for buffering at least the first component at least until a corresponding second component is ready for binding;

wherein the first printing unit generates the triggering signal which indicates a status of the first component and sends this triggering signal to the computer control system; and wherein, for producing a plurality of identical and/or different books, the first printing unit is capable of printing a plurality of first components and the second printing unit is capable of printing a plurality of second components such that the first and second printing units operate independently of each other to produce first and second components.

2. A system according to claim 1, further comprising a binding station for binding the first component and the second component together.

3. A system according to claim 2, further comprising a first transfer unit for transferring the first component to the binding station;

a second transfer unit for transferring the second component to the binding station.

4. A system according to claim 2, wherein the computer control system effects transfer of one of the first component and second component into the binding station, upon receipt of information that the binding station is ready for receiving book components for binding, and wherein the computer control system effects transfer of the first component into the binding station upon receipt of information regarding a successful positioning of the second component in the binding station.

5. A system according to claim 1, wherein the computer control system receives or has information relating to the book to be manufactured, the information comprising information relating to the content of the first or second component and information relating to the finished size of the book.

6. A system according to claim 1, wherein the first component is a cover and the second component is a book block comprising a plurality of text pages.

7. A system according to claim 1, wherein the first printing unit comprises a cover printing unit and the second printing unit comprises a book printing unit for sequentially printing a plurality of text pages constituting a book block.

8. A system according to claim 1, wherein the first printing unit comprises at least one digital cover printer and wherein the second printing unit comprises at least one digital printer for printing a plurality of text pages constituting a book block.

9. A system according to claim 1, wherein the computer control tracks each of the first components or second components.

10. A system according to claim 1, wherein the first buffer unit is a random access buffer.

11. A system according to claim 1, further comprising a second buffer unit for buffering at least the second component at least until the binding station is ready for binding.

12. A system according to claim 11, wherein the second buffer unit is a first-in-first-out buffer.

13. A system according to claim 1, further comprising a trimming unit for trimming excess margins of the bound book along one or more edges thereof so as to form a book of a predetermined size.

14. A system according to claim 1, further comprising a laminating unit for laminating the first component and/or a varnishing unit for coating the first component.

15. A system according to claim 1, further comprising a quality control unit which controls the quality of the first component and generates a signal containing the information that the production of the first component is successful and sends this signal to the computer control system.

16. A system according to claim 1, wherein the status of the first component is a partial completion status.

17. A system according to claim 1, wherein the status of the first component is a completion status.

18. A system according to claim 1, wherein the second component is a cover and the first component is a book block comprising a plurality of text pages.

19. A method of manufacturing a book on demand, the book comprising at least a first component and a second component, the method comprising:

initiating a production of the first component and producing the first component;

initiating a production of the second component and producing the second component; and buffering at least the first component at least until a corresponding second component is ready for binding;

wherein the production of the second component is initiated only after receipt of a triggering signal, wherein the triggering signal is based on a status of the first component.

20. A method of manufacturing a plurality of books on demand, which may be of a different size and have a different content, each of the books comprising at least a first component and a second component, the method comprising:

producing a first component of a first book;

initiating a production of a second component of the first book after receipt of a triggering signal, wherein the triggering signal is based on a status of the first component, and producing the second component of the first book;

binding the first component of the first book and the second component of the first book together, producing a first component of a further book after completion of the production of the first component of the first book; and producing a second component of the further book after completion of the production of the second component of the first book;

wherein the first and second components of the first book and the first and second components of the further book are produced independently of each other.

21. A method according to claim 20, wherein the triggering signal is a signal that the production of the first component is successful.

22. A method according to claim 20, further comprising binding the first component and the second component together with an adhesive.

23. A method according to claim 20, further comprising transferring the first component of the first book to a first buffer; and transferring the first component of the further book to the first buffer.

24. A method according to claim 20, further comprising transferring the first component of the first or the further book from the first buffer to a binding station upon receipt of a signal that the second component belonging to the first or the further book is ready for binding.

25. A method according to claim 20, further comprising producing the first components of the first book and the further books sequentially one after the other or in a parallel manner; and producing the second components of the first book and the further books sequentially one after the other or in a parallel manner, in order of the completion of the first components.

26. A method according to claim 20 wherein the first component is a cover and the second component is a text block of a book to be manufactured.

27. A method according to claim 20, further comprising controlling the quality of the first component and generating and sending a signal to the computer control system that the quality of the first component is satisfactory.

28. A method according to claim 20, further comprising transferring the first component of the book to a first buffer.

29. A method according to claim 28, further comprising transferring the first component of the book from the first buffer to the binding station upon receipt of a signal that the second component associated with the first component is ready for binding.

30. A system for manufacturing a book on demand, the book comprising at least a first component and a second component, the system comprising:

a first printing unit for printing the first component;

a second printing unit for printing the second component;

a computer control system which initiates printing of the first component by the first printing unit, receives a triggering signal and, after receipt of this triggering signal, initiates printing of the second component by the second printing unit, wherein the triggering signal is generated by the first printing unit based on a status of the first component;

a first transfer unit for transferring the first component to a next station;

a second transfer unit for transferring the second component to the next station; and a first buffer unit for buffering at least the first component at least until a corresponding second component is transferred or ready to be transferred to the next station; such that the buffer unit can store the first component to allow for transfer to an arbitrary next station without regard to a physical relationship between the units.

31. A system according to claim 30, wherein the next station is a binding station for binding the first and second component together.

32. A system according to claim 30, further comprising a computer control system which initiates printing of the first component by the first printing unit, receives a triggering signal and, after receipt of this triggering signal, initiates printing of the second component by the second printing unit.

33. A system according to claim 32, wherein the computer control system receives or has information relating to the book to be manufactured, the information comprising information relating to the content of the first or second component and information relating to the finished size of the book.

34. A system according to claim 32, wherein the triggering signal is a signal that the printing of the first component is successful.

35. A system according to claim 32, wherein the first printing station generates a signal that the printing of the first component is successful after completion of the printing and sends this signal to the computer control system.

36. A system according to claim 30, wherein, for producing a plurality of identical and/or different books, the first printing unit is capable of printing a plurality of first components sequentially and/or in a parallel manner and the second printing unit is capable of printing a plurality of second components sequentially and/or in a parallel manner.

37. A system according to claim 30, wherein the first component is a cover and the second component is a book block comprising a plurality of text pages.

38. A system according to claim 30, wherein the first printing unit comprises a cover printing unit and the second printing unit comprises a book printing unit for sequentially printing a plurality of text pages constituting a book block.

39. A system according to claim 30, wherein the first printing unit comprises at least one digital cover printer and wherein the second printing unit comprises at least one digital printer for printing a plurality of text pages constituting a book block.

40. A system according to claim 30, wherein a computer control system effects transfer of one of the first component and second component into the next station, upon receipt of information that the next station is ready for receiving book components, and wherein the computer control system effects transfer of a second first component into the next station upon receipt of information regarding a successful positioning of a first second component in the next station.

41. A system according to claim 30, wherein a computer control tracks each of the first components or second components.

42. A system according to claim 30, wherein the first buffer unit is a random access buffer.

43. A system according to claim 42, wherein the second buffer unit is a first-in-first-out buffer.

44. A system according to claim 30, further comprising a second buffer unit for buffering at least the second component at least until the next station is ready for receiving book components.

45. A system according to claim 30, further comprising a trimming unit for trimming excess margins of the bound book along one or more edges thereof so as to form a book of a predetermined size.

46. A system according to claim 30, further comprising a laminating unit for laminating the first component and/or a coating unit for coating the first component.

47. A system according to claim 30, further comprising a quality control unit which controls the quality of the first component and generates a signal containing information that the production of the first component is successful and sends this signal to the computer control system.

48. A method of manufacturing a book on demand, the book comprising at least a first component and a second component, with the following steps:

initiating a production of the first component and producing the first component, initiating a production of the second component after receipt of a triggering signal, wherein the triggering signal is based on a status of the first component, and producing the second component of the book;

transferring the first component to a next station via a first buffer; and transferring the second component to a next station; such that the buffer unit can store the first component to allow for transfer to an arbitrary next station.

49. A system for manufacturing a book on demand, the book comprising at least a first component and a second component, the system comprising:

a first printing unit for printing the first component;

a second printing unit for printing the second component;

a binding unit for binding the first component and the second component together;

a first transfer unit for transferring the first component to a next unit;

a second transfer unit for transferring the second component to a next unit;

a computer control system which initiates printing of the first component by the first printing unit, receives a triggering signal from the first printing unit, the triggering signal representing a status of the first component, and, after receipt of this triggering signal, initiates printing of the second component by the second printing unit;

a trimming unit for trimming excess margins of the bound book along one or more edges thereof so as to form a book of a predetermined size; and a laminating unit for laminating the first component and/or a coating unit for coating the first component;

wherein the computer control system controls the order and assignment of the first and second components to the first transfer unit, the second transfer unit, the binding station, the trimming unit and the laminating unit.

* * * * *